US005077989A

United States Patent [19]

Dillabaugh

[11] Patent Number: 5,077,989

[45] Date of Patent: Jan. 7, 1992

[54] INTERCHANGEABLE SETTING

[76] Inventor: Harry Dillabaugh, 999 Fry Blvd., Suite 214, Sierra Vista, Ariz. 85635

[21] Appl. No.: 483,442

[22] Filed: Feb. 22, 1990

[51] Int. Cl.[5] ..... A44C 17/02

[52] U.S. Cl. ..... 63/29.1; 24/597

[58] Field of Search ..... 63/2, 12, 15, 26, 29.1; 24/597

[56] References Cited

U.S. PATENT DOCUMENTS

| | | | |
|---|---|---|---|
| 1,069,254 | 8/1913 | Henning | 63/29.1 |
| 1,080,735 | 12/1913 | Tolchin . | |
| 1,592,561 | 7/1926 | Godley | 63/26 X |
| 2,108,324 | 2/1938 | White et al. | 63/29.1 |
| 2,118,335 | 5/1938 | Ahlquist | 63/15 |
| 2,253,343 | 8/1941 | Nalick | 63/29 |
| 2,316,225 | 4/1943 | Hoffman et al. | 63/29 |
| 2,354,513 | 7/1944 | Fitzer | 63/15 |
| 2,519,152 | 8/1950 | Piotrowski | 63/29.1 |
| 2,537,449 | 11/1951 | Evenson | 63/15 |
| 2,567,069 | 9/1951 | Harley | 24/597 |
| 3,115,758 | 12/1963 | Eberle et al. | 63/15 |
| 3,509,734 | 5/1970 | Lederer | 63/15 |
| 3,605,438 | 9/1971 | Chalson | 63/20 |
| 3,933,011 | 1/1976 | DiGitio et al. | 63/29.1 |
| 4,216,567 | 8/1980 | Heinz | 24/597 X |
| 4,794,766 | 1/1989 | Schunk et al. | 63/15 |

FOREIGN PATENT DOCUMENTS

| | | | |
|---|---|---|---|
| 469102 | 7/1914 | France | 24/597 |
| 23362 | 10/1912 | United Kingdom | 63/29.1 |

*Primary Examiner*—James R. Brittain
*Attorney, Agent, or Firm*—Heller & Kepler

[57] ABSTRACT

A new and improved apparatus and method of removing and interchanging setting for jewelry has a female finding attached to the jewelry. The female finding contains tapered lips which form a slotted key way, and an internal spring to provide bias against a key when inserted into the key way. A male finding which has a key made up of a bar pin with tabs extending perpendicular from the bar pin. The key fits into the key way with the tabs extending out into the slotted key way. As the key is inserted the spring provides a bias.

The key is turned 90° and the tabs rotated under the tapered lips until the tabs rest in the notches on the lips. Once the spring holds the key firmly in place. Conventional fingers attached to male finding provides a mount for a stone or other desired setting.

14 Claims, 1 Drawing Sheet

INTERCHANGEABLE SETTING

BACKGROUND OF THE INVENTION

The present invention relates in general to an item of jewelry and pertains, more particularly, to an interchangeable setting directed to use in combination with items of jewelry. The interchangeable setting of this invention is an improvement over the conventional changeable settings.

With the conventional changeable settings it is generally necessary to provide, contain small removable parts which are easily lost, designed so that all except the nimblest of fingers can work the design, and is not costly to manufacture. These conventional arrangements include the following representative references disclosing some form of changeable setting.

The Schunk reference, U.S. Pat. No. 4,794,766, discloses an interchangeable stone held in place by clamps which are under tension by ornamental screws. The Chalson reference, U.S. Pat. No. 3,605,438 discloses settings on a bar pin where the bar pin extends through an ornamental background and the settings, including ornamental backgrounds, can be mixed and matched. They are held in place by a spring clip over the bar pin.

A stone setting can be removed for various split and hinged rings as disclosed in the following references: Elliot, U.S. Pat. No. 899,296; Obsboan, U.S. Pat. No. 1,152,340; and Estrin, U.S. Pat. No. 2,316,225.

The Evanson reference, U.S. Pat. No. 2,537,445, discloses settings which can be snapped or screwed into place. The Lederer reference, U.S. Pat. No. 3,509,734, discloses a setting held in place magnetically. The Eberle reference, U.S. Pat. No. 3,115,758, discloses a setting held in place by a spring loaded mount. The Nalick reference, U.S. Pat. No. 2,253,343, discloses an emblem held on a ring by screws and the Felzer reference, U.S. Pat. No. 2,354,513, discloses a setting with a bar pin held in place by a set screw in the ring.

Conventional changeable settings do not meet the need for an uncomplicated, and low cost manner for providing a means to mix and match settings within a single piece of jewelry with few parts to lose and which is easily manipulated by the public.

Accordingly, it is an object of the present invention to provide an improved interchangeable setting for use with jewelry.

Another object of the present invention is to provide an interchangeable setting with relatively few completely removable parts.

A further object of the present invention is to provide an interchangeable setting readily used by the general public and easily, without complications, removed and interchanged with a variety of settings on the same piece of jewelry.

Still another object of the present invention is to provide an interchangeable setting and a piece of jewelry for receiving the interchangeable settings, both of which can be economically produced.

SUMMARY OF THE INVENTION

To accomplish the foregoing and other objects of this invention there is provided an interchangeable setting in which a female finding receives a variety of male findings, thereby providing a piece of jewelry, for example a ring, having a removable setting that provides the wearer with a variety of settings that can be removed and replaced as the wearer wishes of fashion dictates.

In a preferred embodiment an item of jewelry, such as a ring, has a female finding cast as part of or attached to the ring. The female finding includes a notched key way. The notched key way receives a key attached to the male finding on the setting and once a spring bias is overcome, then the key is either inserted into or removed from the key way. In the preferred embodiment a gasket on the male finding provides an improved fit between the male and female finding members.

In operation, it is only necessary to push the setting towards the base to overcome the spring bias, twist the setting 90 degrees and release. The steps for inserting and removing the setting are opposite each other and uncomplicated.

These and other objects and features of the present invention will be better understood and appreciated from the following detailed description of one embodiment thereof, selected for purposes of illustration and shown in the accompanying drawing.

DETAILED DESCRIPTION

Figure 1:
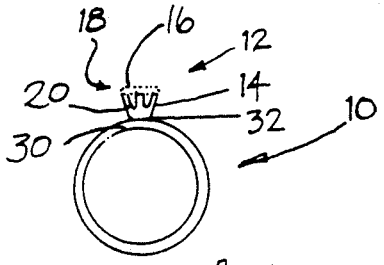
FIG. 1 is a side elevation of a ring and setting combination constructed in accordance with the present invention.

Referring now to the drawings there is shown a preferred embodiment for the interchangeable setting and associated piece of jewelry of this invention. The interchangeable setting is described in connection with a ring application to provide a variety of settings for a single ring. The setting of the present invention is particularly adapted for providing a variety of settings for the owner of the jewelry.

The drawings show a ring 10 in conjunction with a setting 12 having means for securing the setting or stone. In the illustrated embodiment fingers 14 are provided to secure the stone 16. The setting 12, in accordance with the present invention, may be removed from the ring 10 and replaced with a similar setting constructed in accordance with this invention. It will be understood that the setting 12 may be a stone, gem, or emblem or any other ornamental item typically found on jewelry.

In the preferred embodiment illustrated, the setting 12 is held or secured by the plurality of fingers 14. Those skilled in the art will recognize that the particular style or size of finger 12 may vary and the drawing figures illustrate a typical style or fashion.

Continuing now with a description of one preferred embodiment, the fingers 14 are attached to a male finding member 18 at a head portion 20. Typically, the fingers 14 are attached by means of soldering, or are molded as part of the finding 18. Other methods are known to secure or join the fingers 14 to the head portion 20. The male finding 18 is typically made from a non-precious metal such as an alloy of steel, while the fingers 14 are made from gold or other metals or materials compatible with the piece of jewelry.

Means for providing a key allow insertion and removal of a setting of the present invention. In particular, a key 22 is provided opposite the fingers 14 on the head portion 20 of the male finding 18. The head portion 20 and the key portion 22 are attached, molded or otherwise formed to provide a single piece and together may be considered to constitute the entire male finding member 18.

The key 22 extends generally outward from the opposing fingers 14. The key 22 includes a longitudinal member that extends into a key way as described below. The extending longitudinal member provides a bar pin 24. At least one generally transverse member extends outward from the longitudinal member. In a preferred embodiment two tabs 26 are provided. The opposing tabs 26 protrude outward and generally perpendicularly from the bar pin 24. In the illustrated embodiment the tabs are 180° degrees apart.

It will be understood that the key and the key way combination may vary. For example, the key 22 may be formed with one or more tabs and the tabs need not be limited to a 180° spacing about the longitudinal member.

A female finding 28 is associated with the main piece or body of the jewelry 30. In a preferred embodiment a separate piece provides a base portion 32 of the female finding. This piece can attached to the jewelry by soldering, welding, screws, or other known manufacture methods. Molding or another manufacturing technique may be used to form the base portion 32 with the jewelry, for example, the ring 10. In view of the jewelry style illustrated herein, the base portion 22 is circular.

A wall member 34 extends upwards and generally perpendicular from the base portion 22. The wall 34 for the illustrated embodiment is circular in order to conform to the shape of the base portion 22. The wall defines a cylinder open at its upper end and at least partially closed by the base portion 22 at its lower end.

It will be appreciated that the base portions 32 may be other than circular. In these embodiments it may be desired to modify the cylinder such that a transverse cross section through the cylinder defines a shape generally complementary to the head portion 20. In this way the top of the cylinder will conform to a sealing member or gasket as will be further described below.

Figure 2:
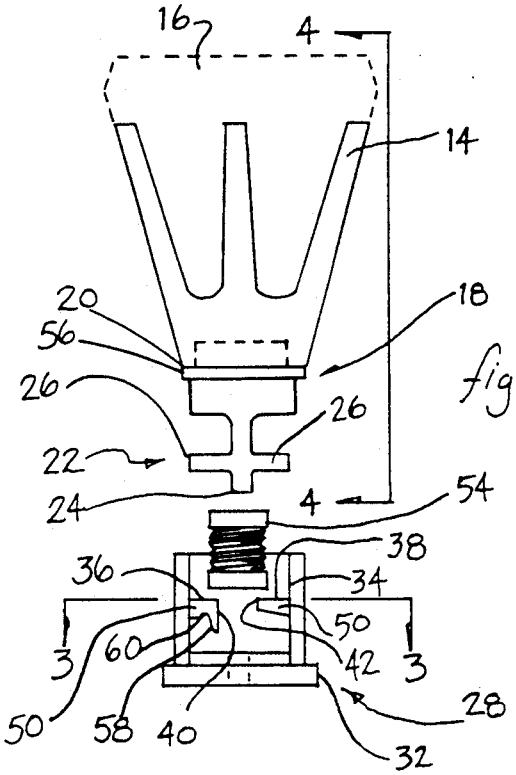
FIG. 2 is an exploded view of the female and male findings.

Referring again to the illustrated embodiment, and in particular to FIG. 2, extending inward from the cylinder 34 within the wall 22 of the cylinder are key way defining members. In the illustrated embodiment opposing retaining members or lips 36, 38 define the key way means. These opposing members or lips 36, 38 extend generally inward from the inner surface of cylinder wall. The opposing members attach to the walls opposite each other and a generally equal distance from the top of the cylinder wall 34.

The opposing edges 40, 42 are generally parallel and form a key way 44. A preferred embodiment of the key way 44 is defined by a slot portion 46 and generally central circular opening 48. The slot portion defines slots of generally equal length with the opening 48 generally intermediate the cylinder 34. The center opening 48 is formed by the edges forming the slots.

The key way 44 and the key 22 have complementary shapes or configurations. As illustrated in the accompanying drawing figures, the longitudinal member or bar pin 24 is received by the circular opening 48 and the opposing transverse members 26 are received by the key way slot portion 46.

Figure 3:
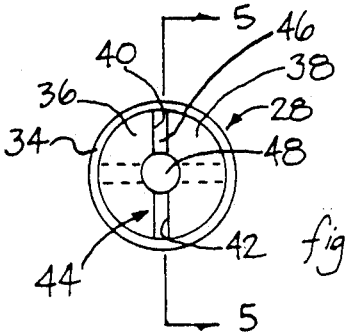
FIG. 3 is a view taken generally along line 3—3 in FIG. 2.
Figure 5:
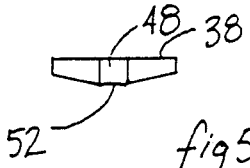
FIG. 5 is a view taken generally along line 5—5 in FIG. 3.
Figure 4:
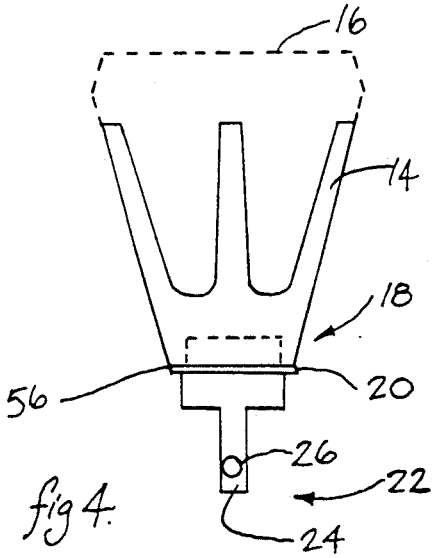
FIG. 4 is a view taken generally along line 4—4 in FIG. 2.

The opposing lip members 36, 38 have a compound taper from the base portion 50 to the edge defining the key way slot portion 46 and from one end of the slot towards the center opening 48 as illustrated in FIGS. 3 and 5. In a preferred embodiment the thickness of the lip members is a maximum at the portion defining the center opening 48 and tapers away to form a transverse member receiving notch. FIG. 5 depicts the edge of the circular opening 48 and illustrates that the taper changes to an arc defining the notch 52.

A bias member is provided to resist removal of the male finding member 18. In a preferred embodiment the bias member is provided by a hardened spring 54. The spring is restrained within the female finding member 28. The spring 54 is positioned against the base portion 32 and the lip members 36, 38. The spring 54 is positioned within the female finding member 28 prior to attachment of the walls or cylinder 34 to the base portion 32.

In other preferred embodiments the wall or cylinder portion 34 may be made for threaded connection to the base portion 32. It is also known to assemble jewelry by crimping, or soft soldering, for example, and these methods may be applied equally as well to the construction of the present invention.

In operation, in connection with the jewelry and ring application previously mentioned to provide an interchangeable setting, the spring 54 provides a resisting bias against the key 22 and securely holds the transverse members or tabs 26 in their respective notches 52. Therefore, to insert a desired setting 12 into the ring 10, the setting is firmly grasped and the key 22 aligned with the key way 44.

It requires a relatively small, yet significant force to overcome the bias of the spring 54 and insert the key 22 into the key way 44 and rotate the setting 12 90° in order to align the transverse members or tabs 26 with their respective receiving notches 52. Upon release the setting obtains its desired position within the ring. Removing the setting requires the opposite steps.

In another preferred embodiment, a gasket member 56 is provided to improve the seat of the setting on the cylinder and is preferably made from rubber, nylon, or other similar material. The gasket 56 fits between the male finding member 18 and the female finding member 28 in order to provide a better fit and to better seal the intermediate joint.

From the foregoing description those skilled in the art will appreciate that all of the objects of the present invention are realized. An uncomplicated, and low cost manner for providing a means to mix and match settings within a single piece of jewelry with few parts to lose and which is easily manipulated by the public has been provided.

While specific embodiments have been shown and described, many variations are possible. The particular shape of the ring, setting, or key and key way configuration may be changed as desired to suit the jewelry with which it is used. The configuration and number of notches and angular distance between notches and number of slots may vary with style, type, or size of jewelry with which it is intended to by used. Other materials may be used, from the most expensive metals for fine crafted articles to the least expensive for costume jewelry items. Finally, it will be understood that the female finding member could be associated with the setting and the male finding member associated with the ring body.

While a specific embodiment has been illustrated many variations are possible. The particular key, key way, type of biasing and means of holding the finding together may be altered, changed or modified without departing from the broad invention concepts comprehended by the invention. As illustrated in FIG. 2 a depending finger 58 provides an additional restraint for the spring 54 and a stop for the bar pin or tab. The finger is inserted into the spring and the upper edge of the spring fits into groove 60 for additional lateral support of the spring member 54.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. An interchangeable setting comprising:
an item of jewelry for receiving a setting;
the setting for display with the item of jewelry;
combination key and key way means for joining the setting to the item of jewelry;
bias means for resisting insertion of the key means into the key way means and removal of the key means from the key way means; and
a stop means defined by the key way means, the stop means limiting motion of the key means within the key way means, and the stop means in engagement with the bias means for providing lateral restraint against lateral motion of the bias means within the key way means.

2. An interchangeable setting as set forth in claim 1, wherein the key means of the setting is secured to the key way means of the jewelry item by inserting the key means into the receiving key way means and twisting the key means in order to lock the key means in place against the stop means.

3. An interchangeable setting for a jewelry item as set forth in claim 1, further comprising:
a male finding member of the setting;
the key means carried by the male finding member;
a female finding member of the jewelry item;
a base attached to the female finding member;
wall means extending away from the female finding member; and
opposing retaining members associated with the wall means, the opposing retaining members providing restraint for the key means of the setting when inserted into the key way means of the female finding member of the jewelry item.

4. An interchangeable setting as set forth in claim 3, wherein the wall means define an opening generally complementary to an adjacent abutting surface of the male finding member of the setting.

5. An interchangeable setting as set forth in claim 4, wherein the wall means includes generally cylindrical walls having opposing lips extending inward and thereby forming the key way means.

6. An interchangeable setting as set forth in claim 5, wherein the lips of the jewelry item have compound tapered portions and define a key means receiving notch.

7. An interchangeable setting as set forth in claim 1, wherein the key means includes a male finding having a bar pin, extending from a head portion of the male finding, with tabs generally transverse to a longitudinal member defining the bar pin portion, whereby the bar pin forms a key.

8. An interchangeable setting as set forth in claim 1, wherein the biasing means consists of a hardened spring.

9. An interchangeable setting as set forth in claim 1, wherein the key means of the jewelry item is secured to the key way means of the setting by inserting the key means into the receiving key way means and twisting the key means in order to lock the key means in place.

10. An interchangeable setting for a jewelry item as set forth in claim 1, further comprising;
a male finding member of the jewelry item;
the key means carried by the male finding member;
a female finding member of the setting;
a base attached to the female finding member;
wall means extending away from the female finding member; and
opposing retaining members providing restraint for the key means of the jewelry item when inserted into the key way means of the female finding member of the setting.

11. An interchangeable setting as set forth in claim 10, wherein the wall means define an opening generally complementary to an adjacent abutting surface of the male finding member of the jewelry item.

12. An interchangeable setting as set forth in claim 11, wherein the setting includes lips and the lips define compound tapered portions and define a key means receiving notch.

13. An interchangeable setting as set forth in claim 12, wherein a finger depends from a lip so as to generally secure the bias means against substantial lateral movement.

14. An interchangeable setting as set forth in claim 13, wherein the depending finger defines a groove shaped portion for receiving an upper edge of the bias means.

* * * * *